US009896824B2

(12) United States Patent
Kanniappan et al.

(10) Patent No.: US 9,896,824 B2
(45) Date of Patent: Feb. 20, 2018

(54) GROUND ENGAGING TOOL SYSTEM

(71) Applicant: Caterpillar Inc., Peoria, IL (US)

(72) Inventors: Gopalakrishnan Kanniappan, Tamil Nadu (IN); Kadirvel Muthusamy, Tamil Nadu (IN); Venkatesh Madeshi, Tamil Nadu (IN); Gregory Seljestad, War, KS (US); Anuop Udayakumar, Tamil Nadu (IN); Ashok Rajendran, Tamil Nadu (IN)

(73) Assignee: Caterpillar Inc., Peoria, IL (US)

( * ) Notice: Subject to any disclaimer, the term of this patent is extended or adjusted under 35 U.S.C. 154(b) by 169 days.

(21) Appl. No.: 14/833,308

(22) Filed: Aug. 24, 2015

(65) Prior Publication Data

US 2017/0058492 A1 Mar. 2, 2017

(51) Int. Cl.
*E02F 9/28* (2006.01)

(52) U.S. Cl.
CPC ..... *E02F 9/2883* (2013.01)

(58) Field of Classification Search
CPC ..... E02F 9/28; E02F 9/2883
USPC ..... 172/681, 720, 753, 762, 763
See application file for complete search history.

(56) References Cited

U.S. PATENT DOCUMENTS 1,094,437 A * 4/1914 Harris ..... A01B 15/18 172/359
3,082,555 A * 3/1963 Hill ..... E02F 9/28 172/719
3,496,658 A * 2/1970 Eyolfson ..... E02F 9/28 37/455
3,773,114 A * 11/1973 Griffin ..... A01B 35/225 172/762
4,195,697 A * 4/1980 Griffin ..... A01B 35/26 172/730
5,241,765 A * 9/1993 Jones ..... E02F 3/60 172/772
5,913,605 A * 6/1999 Jusselin ..... E02F 9/28 172/772
5,937,549 A * 8/1999 Bender ..... E02F 9/2825 172/772
6,898,864 B2 5/2005 Allen
7,526,886 B2 * 5/2009 McClanahan ..... E02F 9/2841 37/450
D623,671 S * 9/2010 Bolyard ..... D15/32
8,336,233 B1 12/2012 Lombardo et al.
8,967,287 B2 3/2015 Rivera et al.
9,015,967 B2 4/2015 May
9,315,972 B2 * 4/2016 Anisy ..... E02F 9/2825
9,371,631 B2 * 6/2016 Karlsson ..... E02F 9/2825
9,574,330 B2 * 2/2017 Plouzek ..... E02F 9/2883
(Continued)

*Primary Examiner* — Gary S Hartmann

(57) ABSTRACT

A wear plate assembly for a ground engaging system. The wear plate assembly includes a wear plate, a connection plate, and a lock cavity. The wear plate has a back surface and a front surface spaced from the back surface along a first direction. The connection plate extends from the front surface at least partially in the first direction. The connection plate has an inner surface and an outer surface spaced from the inner surface along a second direction. The lock cavity is formed by the connection plate. The lock cavity extends from a first opening that opens to the inner surface to a second opening that opens to the outer surface. The first opening has a first diameter and the second opening has a second diameter that is smaller than the first diameter.

9 Claims, 9 Drawing Sheets

(56) References Cited

U.S. PATENT DOCUMENTS

| | | | |
|---|---|---|---|
| 2013/0269221 | A1 | 10/2013 | Pippins |
| 2015/0013197 | A1 | 1/2015 | Campomanes |

* cited by examiner

GROUND ENGAGING TOOL SYSTEM

TECHNICAL FIELD

This disclosure relates generally to construction equipment, and more particularly, to a ground engaging tool system having replaceable components.

BACKGROUND

Block handling clearing rakes are generally used for separating stone pieces from a pile of stone and positioning the material such that it can be accessed and moved by an implement like a fork that is attached to the machine. During use, the clearing rake can be subjected to wear from the abrasion and impacts experienced during the earth working applications.

The wear of the clearing rake leads to repair or worn parts, replacement of individual components, and eventually the replacement of the rake. The process for replacing each individual component can be cumbersome, costly, and not easily performed at a work location. Welding is often involved in replacing components which increases the amount of effort and time required to remove each component, and increases the risk of weld stresses, therefore decreasing predicted service life of the clearing rake.

A current system for replacing components of a ground engaging machine is described in U.S. Patent Publication No. 2013/0269221 A1. The described system involves excavating equipment that includes removably attaching a tooth point to an adapter. The tooth point is mounted onto the adapter by using one or more tooth point retainer pins. Although this system allows the tooth point to be removed, the system also includes multiple removable components that can be damaged during use or otherwise wear down making the tooth point difficult to remove and reattach.

Thus, an improved ground engaging tool system having easily replaceable components is desired.

SUMMARY

An aspect of the present disclosure provides a wear plate assembly. The wear plate assembly includes a wear plate and a connection plate. The wear plate has a first end, a second end spaced from the first end along a first direction, a back surface, and a front surface spaced from the back surface along a second direction that is substantially perpendicular to the first direction. The back surface and the front surface extend between the first end and the second end. The connection plate extends from the front surface at least partially in the second direction. The connection plate has an inner surface and an outer surface spaced from the inner surface along a third direction. A lock cavity is formed by the connection plate and extends from a first opening that opens to the inner surface to a second opening that opens to the outer surface. The first opening has a first diameter and the second opening has a second diameter that is smaller than the first diameter.

Another aspect of the present disclosure provides a ground engaging tool system. The ground engaging tool system includes a wear plate assembly and a lock. The wear plate assembly includes a wear plate and a connection plate. The wear plate has a back surface and a front surface spaced from the back surface along a first direction. The connection plate extends from the front surface at least partially in the first direction. The connection plate has an inner surface and an outer surface spaced from the inner surface along a second direction. The connection plate defines a lock cavity that extends from a first opening that opens to the inner surface to a second opening that opens to the outer surface. The first opening has a first diameter and the second opening has a second diameter that is smaller than the first diameter. The lock is configured to be rotatably positioned within the lock cavity and configured to rotate between an unlocked position and a locked position. The lock includes a slot configured to receive a post within. When the post is received within the slot and when the lock is in the locked position, the post is prevented from moving from the slot.

Another aspect of the present disclosure provides a ground engaging tool system. The ground engaging tool system includes a wear plate assembly, a rake support member, and a lock. The wear plate assembly includes a wear plate and a connection plate. The wear plate has a back surface and a front surface spaced from the back surface along a first direction. The connection plate extends from the front surface at least partially in the first direction, the connection plate having an inner surface and an outer surface spaced from the inner surface along a second direction. The connection plate defines a lock cavity that extends from a first opening that opens to the inner surface to a second opening that opens to the outer surface. The first opening has a first diameter and the second opening has a second diameter that is smaller than the first diameter. A receiving cavity is at least partially defined by the inner surface and the front surface.

The rake support member has a first end configured to be positioned within the receiving cavity. The rake support member includes a post coupled to the first end. The lock is rotatably positioned within the lock cavity and configured to rotate between an unlocked position and a locked position. The lock includes a slot configured to receive the post within. When the first end of the rake support member is positioned within the receiving cavity, the post is received within the slot, and when the lock is in the locked position the post is prevented from moving from the slot.

DETAILED DESCRIPTION

The disclosure relates generally to a ground engaging system, such as a clearing rake having a wear plate, configured to clear and control loose work material, such as rocks, stones, or other debris. During operation, the wear plate may become worn and eventually need repair and/or replacement. The wear plate may be slideably removed from an end of the ground engaging system, and replaced with a new wear plate.

Figure 1:
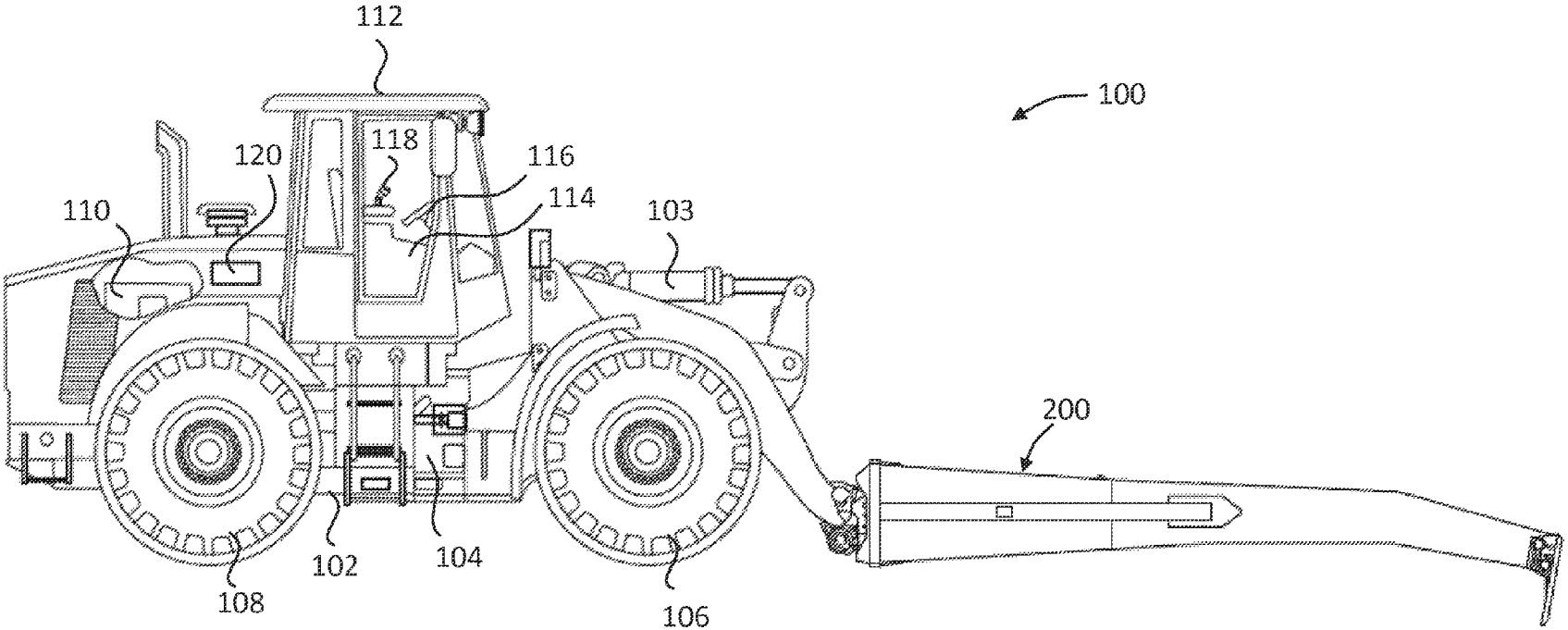
FIG. 1 is a side view of a machine, according to an aspect of this disclosure.

FIG. 1 illustrates a machine 100, according to an aspect of this disclosure. In the illustrated aspect, the machine 100 includes a machine body 102 having a drive system 104 supported thereon configured to drive the front wheels 106 and the rear wheels 108 of the machine 100. The drive system 104 may receive power from an internal combustion engine 110, or other power source, and transmit the power to one or more ground engaging elements, such as front wheels 106, rear wheels 108, or both. The drive system 104 may also include a transmission, a torque converter, final drive assembly, or the like.

The engine 110 may also be configured to provide power for a ground engaging tool system 200, such as a clearing rake system, coupled to the machine body 102 of the machine 100. One or more actuators, for example hydraulic cylinders 103, may be coupled to the machine body 102 to control movement of the ground engaging tool system 200. Work applications capable of being performed by the ground engaging tool system 200 coupled to the machine body 102 may include, but are not limited to, trenching, digging, raking, grading, moving pallets, material handling, snow removal, tilling soil, demolition work, and backfilling.

An operator control station 112 may be mounted to the machine body 102. The operator control station 112 is configured such that an operator may control and direct operation of the machine 100. The control station 112 may include devices such as, for example, a seat assembly 114, a steering device 116, and an engine speed control device 118.

To facilitate control and coordination of the machine 100, the machine 100 may include a controller 120, such as an electronic controller, system computer, central processing unit, or other data storage and manipulation device known in the art. The controller 120 may be used to facilitate control and coordination of any methods or procedures described herein. Components of the controller 120 may include, for example, a processor, memory, and a display that may be housed in the operator control station 112, on the machine 100, located remotely, or any combination thereof. While the controller 120 is represented as a single unit, in other aspects the controller 120 may be distributed as a plurality of distinct but interoperating units, incorporated into another component, or located at different locations on or off the machine 100.

Figure 2:
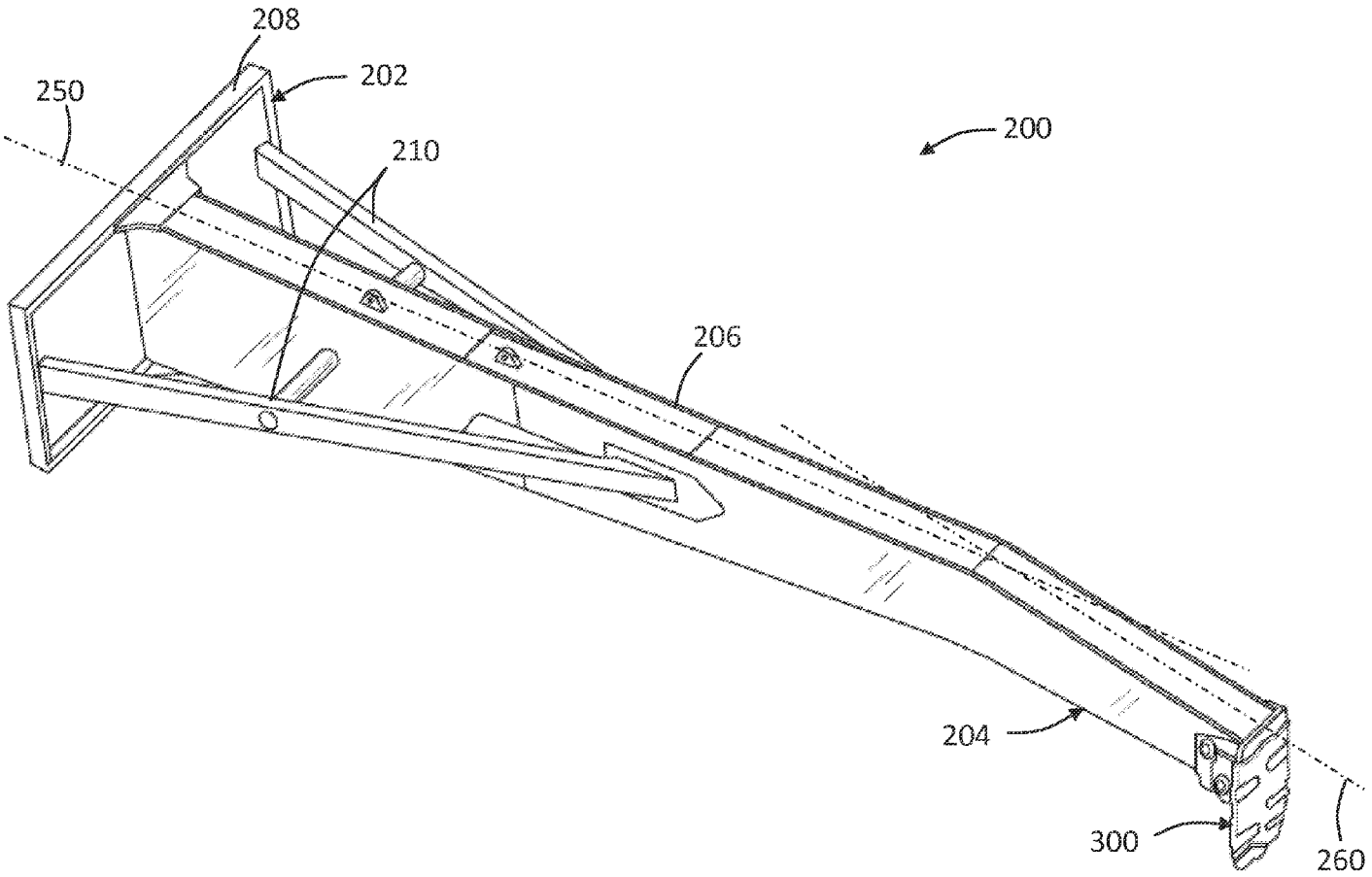
FIG. 2 is a perspective view of a clearing rake, according to an aspect of this disclosure.

FIG. 2 is a perspective view of the ground engaging tool system 200, according to an aspect of this disclosure. The ground engaging tool system 200 may include a support member 206 that has a first portion 202 and a second portion 204 spaced from the first portion 202 along a first longitudinal axis 250. The first portion 202 may include a mounting plate 208 and support arms 210. Referring to FIGS. 1 and 2, the first portion 202 may be secured to the machine body 102 by the mounting plate 208 or other securing mechanism known in the art. The support arms 210 may be coupled to the mounting plate 208 and to the support member 206 to provide support by limiting movement of the support member 206 relative to the mounting plate 208.

A wear plate assembly 300 is coupled to the second portion 204 of the support member 206. In an aspect of this disclosure, the second portion 204 may be angularly offset from the first longitudinal axis 250 and extend at least partially along a second longitudinal axis 260. The angular offset of the second portion 204 from the first longitudinal axis 250 may increase the strength of the support member 206, facilitate ground engaging operations and object placement, enhance operator visibility, or any combination thereof, in addition to other reasons. In an alternative aspect, the first longitudinal axis 250 and the second longitudinal axis 260 may be coaxial.

Figure 3:
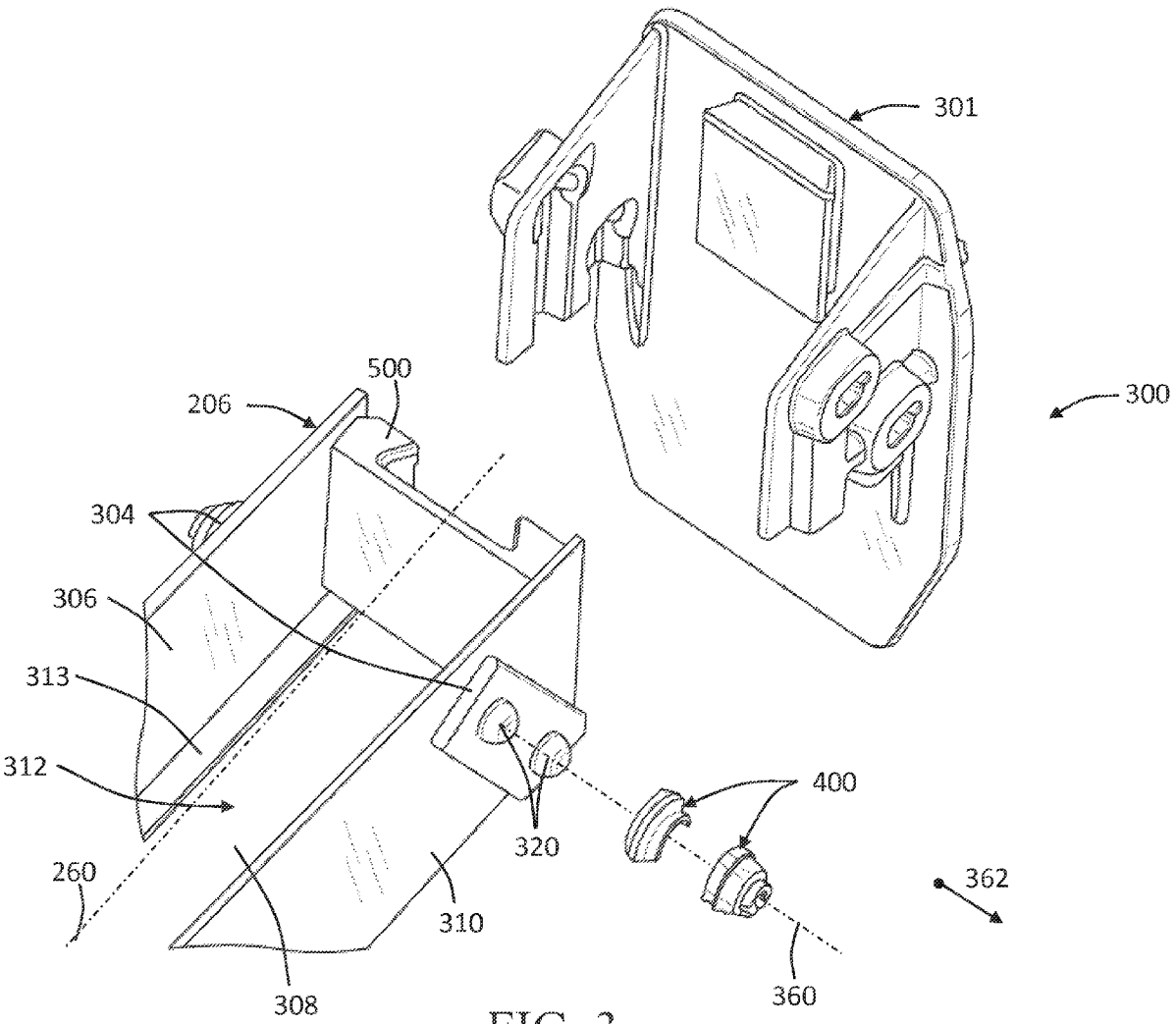
FIG. 3 is an exploded perspective view of a wear plate assembly, according to an aspect of this disclosure.
Figure 4:
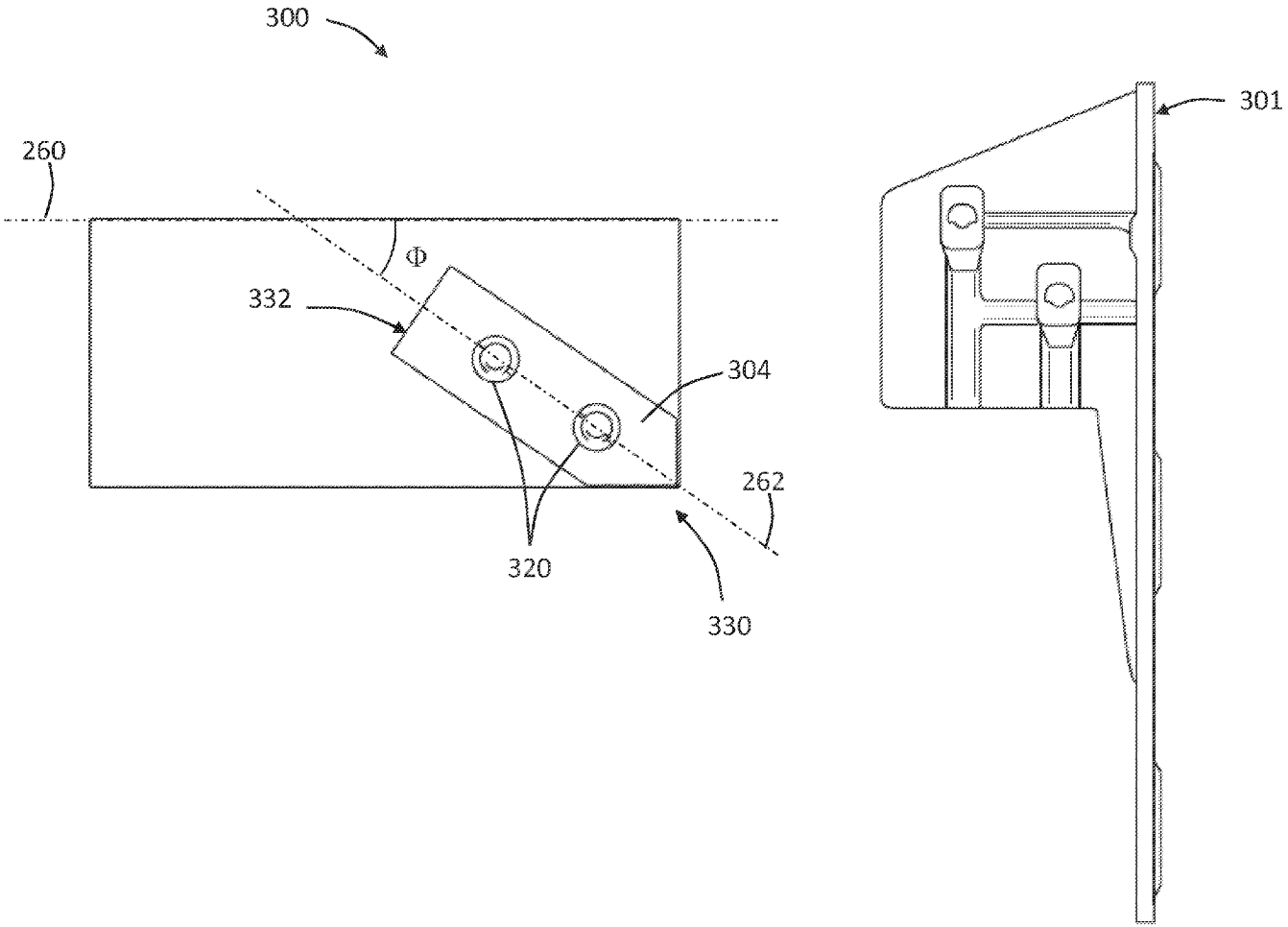
FIG. 4 is an exploded side view of the wear plate assembly shown in FIG. 3.

FIGS. 3 and 4 illustrate an exploded perspective view and an exploded side view of the wear plate assembly 300, respectively, according to an aspect of this disclosure. The wear plate assembly 300 may include a wear plate 301, post plates 304, a lock system 400, and a slide lock retainer 500. The post plates 304 and the slide lock retainer 500 may be coupled to the support member 206 at the second portion 204 by using bolts, welding, adhesives, or other coupling means known in the art.

In an aspect of this disclosure, the support member 206 includes a first support plate 306, a second support plate 308, and a third support plate 310. The first support plate 306 and the third support plate 310 are coupled to the second support plate 308 so as to form a support channel 312 that extends at least partially along the second longitudinal axis 260. The slide lock retainer 500 may be positioned within the support channel 312. The slide lock retainer 500 may be secured to the support member 206 by coupling a first lock retainer side 502, a second lock retainer side 504, and a third lock retainer side 506 (See FIGS. 12 and 13) to the first support plate 306, the second support plate 308, and the third support plate 310, respectively. In alternative aspects, one or more of the lock retainer sides 502, 504, and 506 may be coupled to the support member 206. The support member 206 may include other support plates or beams, such as an additional support beam 313, or other components to further provide support to the ground engaging tool system 200.

Each of the post plates 304 may be coupled to one of the first, second, or third support plates 306, 308, and 310. In an aspect, there may be two post plates 304 that are each coupled to the first support plate 306 and the third support plate 310, respectively. The post plates 304 may be coupled to a side of the support plates 306, 308, and 310 that is located outside the support channel 312.

The post plates 304 may include a first plate end 330 spaced from a second plate end 332 along a plate offset axis 262. The plate offset axis 262 may be angularly offset from the second longitudinal axis 260 by a plate offset angle $\phi$. The plate offset angle $\phi$ may depend upon the configuration of the wear plate 301, as discussed in further detail below.

Each of the post plates 304 may include one or more posts or alignment pins 320 extending therefrom. Each of the posts 320 may be coupled to or integral with one of the post plates 304 and extend outward in a first transverse direction 362 from the support member 206. The first transverse direction 362 may extend along a first transverse axis 360. The posts 320 may be spaced evenly along the post plates 304 from the first plate end 330 to the second plate end 332, or spaced at different locations along the post plates 304.

Figure 6:
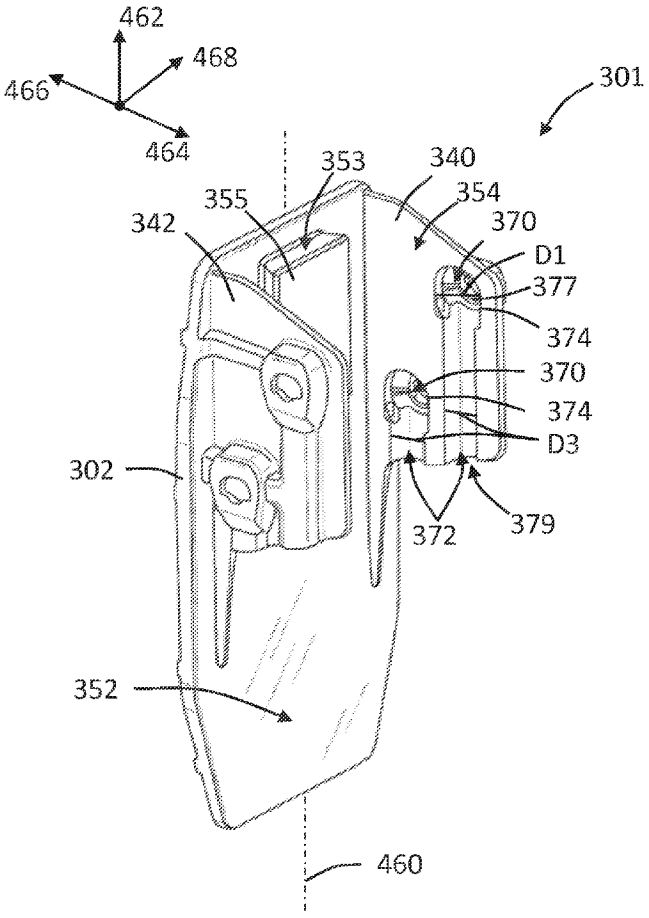
FIG. 6 is a perspective view of a front side of the wear plate shown in FIG. 5.
Figure 5:
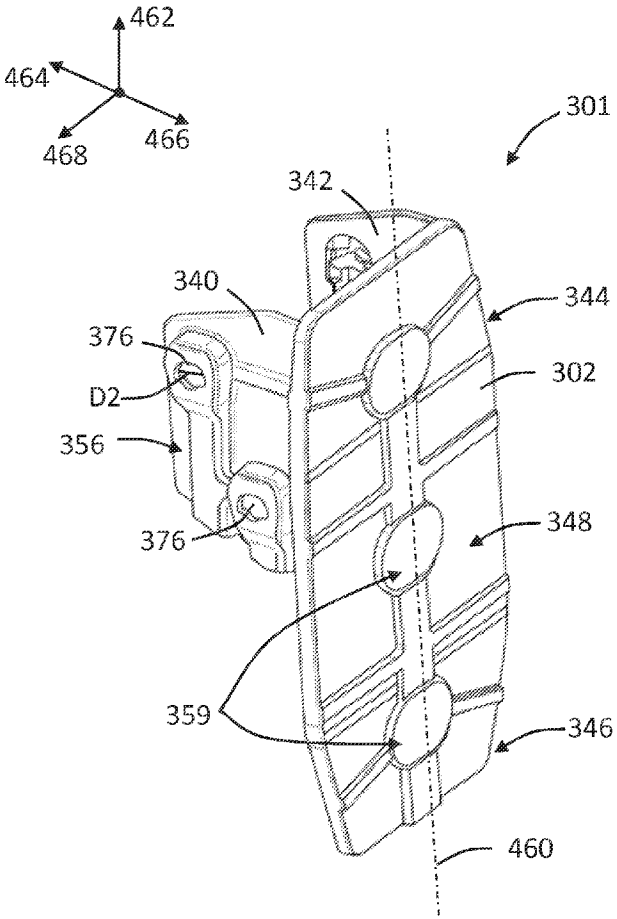
FIG. 5 is a perspective view of a back side of a wear plate, according to an aspect of this disclosure.

FIGS. 5 and 6 illustrate perspective views of the wear plate 301, according to an aspect of this disclosure. The wear plate 301 includes a back wear plate 302, a first connection plate 340, and a second connection plate 342. The first connection plate 340 and the second connection plate 342 extend from the back wear plate 302. The back wear plate 302 includes a first wear plate portion 344, a second wear plate portion 346 spaced from the first wear plate portion 344 along a first wear plate direction 462 that extends parallel to a wear plate axis 460, a back surface 348, and a front surface 352 spaced from the back surface 348 along a second wear plate direction 464 that is substantially perpendicular to the first wear plate direction 462. The back surface 348 and the front surface 352 extend from the first wear plate portion 344 to the second wear plate portion 346. In an aspect of this disclosure, the front surface 352 may be a distance of approximately 40 millimeters from the back surface 348 in the second wear plate direction 464. Unless specified otherwise, use of the word "substantially" herein is intended to mean considerable in extent or largely but not necessarily wholly that which is specified.

The front surface 352 of the back wear plate 302 may include a slide lock member 353 coupled thereto. The slide lock member 353 includes a slide lock back surface (not visible) and an opposing slide lock front surface 355. The slide lock back surface is coupled to the front surface 352 of the back wear plate 302. In an aspect of this disclosure, a cross section of the slide lock member 353, as viewed from the first wear plate direction 462, includes a quadrilateral shape, t-shape, combinations thereof, or other shape such that the slide lock member 353 includes a first diameter that extends in a third wear plate direction 468 that is less than a second diameter that extends in the third wear plate direction 468. The third wear plate direction 468 may be substantially perpendicular to both the first wear plate direction 462 and the second wear plate direction 464.

The back surface 348 may include at least one casting mount 359. Each casting mount 359 may be formed during manufacture by, for example, a casting mold cavity during a casting process. In alternative aspects, each casting mount 359 may be formed by computerized numerical control (CNC) machining, three-dimensional printing, or other commonly used technique for manufacturing the back wear plate 302.

Each of the casting mounts 359 may be positioned along the wear plate axis 460 and extend in an opposing second wear plate direction 466 that is a direction opposing the second wear plate direction 464. In an alternative aspect, each of the casting mounts 359 may be positioned at various locations along the back surface 348 and extend from the front surface 352 to approximately 45 millimeters in the opposing second wear plate direction 466. Each casting mount 359 may provide increased strength and/or rigidity to the back wear plate 302.

The first connection plate 340 and the second connection plate 342 extend from the front surface 352 of the back wear plate 302 at least partially in the second wear plate direction 464. In an aspect of this disclosure, each connection plate 340 and 342 is coupled adjacent to the first wear plate portion 344 of the back wear plate 302. Each of the connection plates 340 and 342 may have a substantially similar structure; therefore, the details of the first connection plate 340 described herein may also apply to the second connection plate 342.

The first connection plate 340 includes an first inner surface 354 and a first outer surface 356 spaced from the first inner surface 354 in the third wear plate direction 468. In alternative aspects, the third wear plate direction 468 may be aligned with the first wear plate direction 462 or may be offset from the first wear plate direction 462 by any angle between 0 and 90 degrees.

The first connection plate 340 may form at least one lock cavity 370 and at least one lock access channel 372. Each lock cavity 370 may include a first opening 374 and a second opening 376 spaced from the first opening 374 in the third wear plate direction 468. The second opening 376 includes a diameter dimension D2 that is smaller than a diameter dimension D1 of the first opening 374. The lock cavity 370 may have an inner cavity surface 377 that has a shape that is conical, frustoconical, rectangular, cylindrical, or combinations thereof, configured to allow the lock system 400 to fit within. Each lock access channel 372 may have a diameter dimension D3 sized to allow at least one post 320 to slideably fit within. Therefore, a diameter dimension (not labelled) of the at least one post 320 may be less than the diameter dimension D3 of the lock access channel 372. The lock access channel 372 may be linear or curvilinear and extend in the first wear plate direction 462 from an intersection 379 between the first inner surface 354 and the first outer surface 356 to the lock cavity 370.

FIGS. 7 through 11 illustrate portions of the lock system 400, including a lock 402 and a retainer bushing 404. The wear plate assembly 300 may include a variety of configurations for accommodating the lock system 400 therein. In the exemplary aspect of the wear plate assembly 300, as shown in FIGS. 3-6, the lock 402 and the retainer bushing 404 may be seated within the lock cavity 370 of the first connection plate 340 when the wear plate assembly 300 is fully assembled onto the support member 206. The lock 402 may be configured to receive at least one post 320 within for locking the first connection plate 340 to the support member 206.

In an aspect of this disclosure, the lock 402 and retainer bushing 404 may be configured to seat within the inner cavity surface 377 of the lock cavity 370 in a manner allowing lock 402 to rotate at least partially around a lock rotation axis 560 relative to the retainer bushing 404. The retainer bushing 404 may seat directly against the inner cavity surface 377 of the lock cavity 370, and lock 402 may seat against retainer inner surface 454 of the retainer bushing 404.

Figure 9:
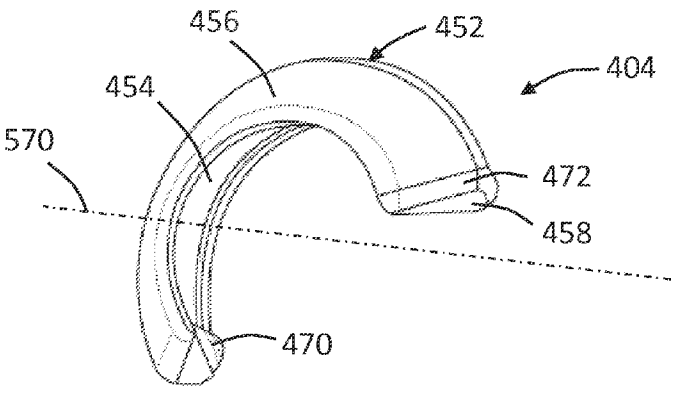
FIG. 9 is a perspective view of a retainer bushing, according to an aspect of this disclosure.
Figure 10:
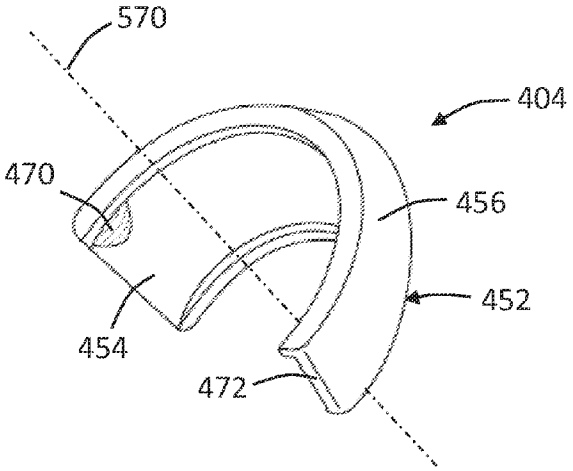
FIG. 10 is another perspective view of the retainer bushing shown in FIG. 9.
Figure 7:
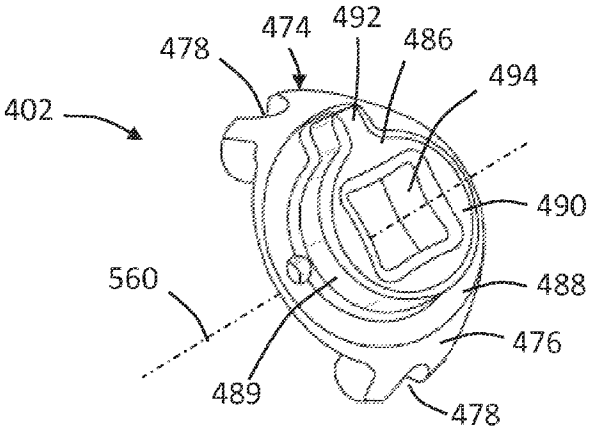
FIG. 7 is a perspective view of a lock of a retainer system, according to an aspect of this disclosure.
Figure 8:
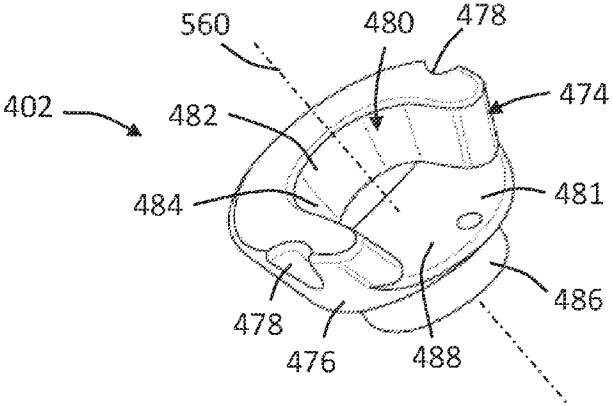
FIG. 8 is a perspective view from a bottom of the lock shown in FIG. 7.

Referring to FIGS. 9 and 10, the retainer bushing 404 may include a C-shaped retainer skirt 452 that extends around a retainer axis 570. The retainer skirt 452 may extend only partway around retainer axis 570.

The retainer bushing 404 may be configured to mate with the inner cavity surface 377 of the lock cavity 370. For example, the retainer bushing 404 may include a retainer outer surface 456 with a frustoconical portion 458 configured to mate with a corresponding frustoconical portion of inner cavity surface 377 in the lock cavity 370. When the retainer bushing 404 is disposed within the lock cavity 370 with frustoconical portion 458 of retainer outer surface 456 mated to the corresponding frustoconical portion of inner cavity surface 377, retainer axis 570 may coincide with lock rotation axis 560 of lock 402 (See FIG. 11).

The lock cavity 370 may be configured such that, when the lock 402 and the retainer bushing 404 are seated in the lock cavity 370, rotation of the retainer bushing 404 with respect to the lock rotation axis 560 is substantially prevented. The retainer inner surface 454 may be opposite the retainer outer surface 456 and extend circumferentially around and concentric with retainer axis 570. Accordingly, the retainer inner surface 454 may extend circumferentially around and concentric with lock rotation axis 560 when the retainer bushing 404 is assembled with the lock 402 in the lock cavity 370.

The retainer bushing 404 may include one or more detents for engaging corresponding detents of lock 402. For example, retainer bushing 404 may include detent projections 470 extending radially inward from retainer inner surface 454. Detent projections 470 may be located at various positions on the retainer bushing 404. Each detent projection 470 may be spaced approximately 180 degrees from one another around the retainer axis 570. In an aspect of this disclosure, a retainer portion 472 of the retainer outer surface 456 that is opposite the location of detent projection 470 may have a smooth surface without any depression or surface discontinuity.

The detent projections 470 may have various shapes. In an aspect, each detent projection 470 may include a generally convex curved surface, such as a constant radius surface, jutting radially outward from the retainer inner surface 454. The convex curved surface may decrease in size (e.g., radius) along a direction substantially parallel to the retainer axis 570.

Figure 11:
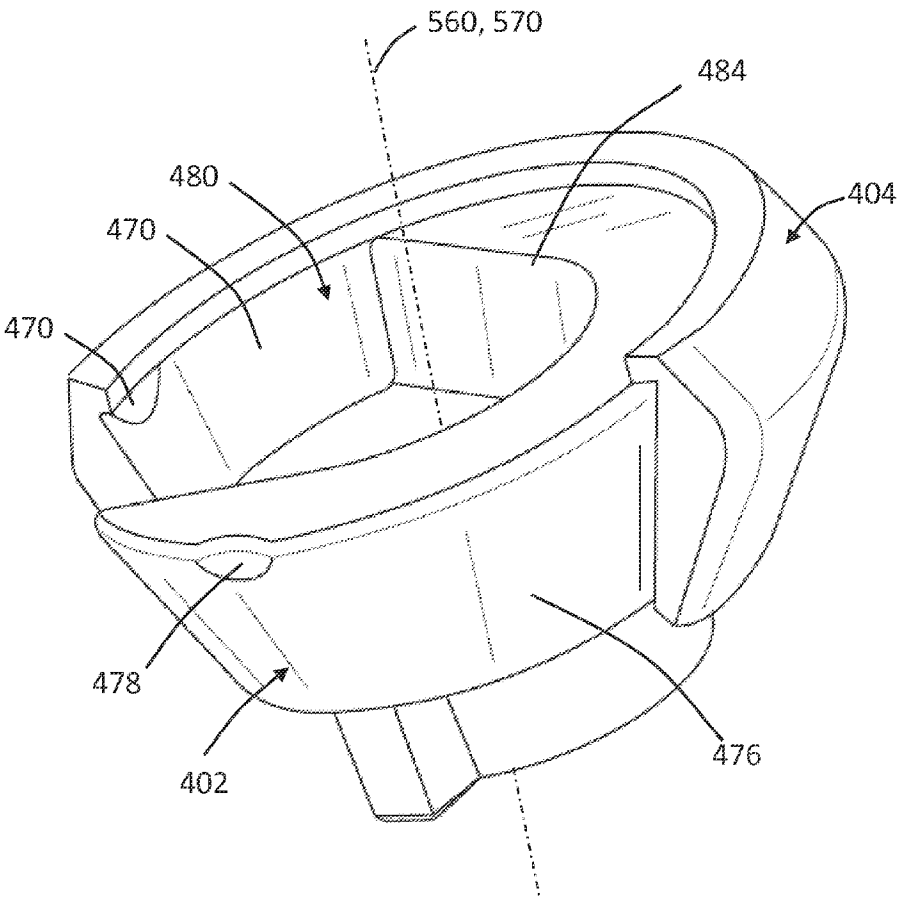
FIG. 11 is a perspective view illustrating a cooperative arrangement between the lock of FIGS. 7 and 8 and the retainer bushing of FIGS. 9 and 10.

As mentioned above, the lock 402 may be configured to mate with the retainer inner surface 454 of the retainer bushing 404, as shown in FIG. 11. For example, the lock 402 may include a lock skirt 474 with a lock outer surface 476 having a substantially similar profile as the retainer inner surface 454 of the retainer bushing 404. The lock outer surface 476 of the lock skirt 474 may be concentric with and extend circumferentially around the lock rotation axis 560. The lock skirt 474 and the lock outer surface 476 may extend only partway around the lock rotation axis 560. For example, the lock skirt 474 and the lock outer surface 476 may extend around the lock rotation axis 560 substantially the same angular degree that retainer skirt 452 of the retainer housing 404 extends around the retainer axis 570. When the lock 402 is positioned within the retainer bushing 404, the lock rotation axis 560 may coincide with the retainer axis 570.

The lock 402 may include one or more detent recesses 478 configured to engage corresponding detent projections 470 of the retainer housing 404 to releasably hold the lock 402 in predetermined rotational positions about the lock rotation axis 560. The detent recesses 478 of the lock 402 may extend radially inward from the lock outer surface 476 of the lock skirt 474. The detent recesses 478 may have a shape configured to mate with the detent projections 470. The detent recesses 478 may include a concave surface, such as a constant-radius curved surface, extending radially inward from the lock outer surface 476. The detent recesses 478 may be spaced approximately the same distance from one another as the detent projections 470. Thus, where the detent projections 470 are spaced approximately 180 degrees from one another, detent recesses 478 may likewise be spaced approximately 180 degrees from one another. Accordingly, the lock 402 may be positioned in the retainer bushing 404 with the lock outer surface 476 seated against the retainer inner surface 454 of the retainer bushing 404 and detent projections 470 extending into detent recesses 478.

The retainer bushing 404 may be configured to deflect so as to allow detent projections 470 to engage and/or disengage detent recesses 478 of the lock 402. In an aspect, the retainer bushing 404 may be constructed at least partially of a flexible material, including but not limited to, a plastic material or an elastomeric material. In an alternative aspect, the retainer bushing 404 may be constructed wholly of such a flexible material.

The retainer bushing 404 may be constructed of self-lubricating material that may either exude or shed lubricating substance. In an aspect, the retainer bushing 404 may be made of thermoplastic material comprising polyoxymethylene (POM). The retainer bushing 404 made of such material may exhibit low friction while maintaining dimensional stability.

The lock 402 may be constructed of metal. Alternatively, all or a portion of the surface of the lock 402 may be coated with a friction-reducing material. The term "friction-reducing material" as used herein, refers to a material that renders the surface of the lock 402 to have a friction coefficient ranging from approximately 0.16 to approximately 0.7.

The lock 402 may be configured to receive at least part of the post 320 of the post plate 304. For example, the lock 402 may include a lock slot 480 extending into the lock skirt 474. The lock slot 480 may have a slot open end 481 between two circumferential ends of the lock skirt 474 and a slot closed end 482. In an aspect, the lock slot 480 may have a size and shape such that it can receive a post 320 having a frustoconical shape. A lock inner surface 484 of the lock skirt 474 may be sloped so as to mate with a post 320 having a frustoconical shape adjacent to the slot closed end 482.

The lock 402 may also include a head portion 486 attached to the lock skirt 474. The head portion 486 may include a wall 488 extending in a plane substantially perpendicular to the lock rotation axis 560. In an aspect, the wall 488 may fully enclose the side of the lock slot 480. The side of the head portion 486 opposite the lock slot 480 may include a projection 490 extending from the wall 488 away from the lock skirt 474 along the lock rotation axis 560. The projection 490 may include a substantially cylindrical outer surface 489 extending around most of the lock rotation axis 560 and a tab 492 extending radially outward relative to the lock rotation axis 560. In an aspect, the tab 492 may extend transverse relative to the direction that the lock slot 480 extends from the slot open end 481 to the slot closed end 482.

As mentioned above, the lock 402 may be installed with the retainer bushing 404 in the lock cavity 370 with outer surface 476 of the lock 402 mated to the retainer inner surface 454 of the retainer bushing 404 and detent recesses 478 of lock 402 mated to detent projections 470 of the retainer bushing 404. When the lock 402 is disposed in this position, the open end 481 of the lock slot 480 may face rearward. This position allows sliding insertion and removal of the post 320 into and out of the lock slot 480 through the open end 481. Accordingly, this position of the lock 402 may be considered an unlocked position.

To lock the post 320 inside the lock slot 480, the lock 402 may be rotated with respect to the lock rotation axis 560 to a locked position. In this locked position, the portion of the lock skirt 474 adjacent to the closed end 482 may preclude sliding movement of the post 320 relative to the lock slot 480, thereby preventing sliding movement of the wear plate 301 relative to the support member 206. The locked position of the lock 402 may be approximately 180 degrees from the unlocked position about the lock rotation axis 560. In the locked position, as in the unlocked position, the detent recesses 478 of the lock 402 may engage the detent projections 470 of the retainer busing 404, which may releasably hold the lock 402 in the locked position.

To rotate the lock 402 between the unlocked position and the locked position, sufficient torque may be applied to the lock 402 with respect to the lock rotation axis 560 to cause the detent projections 470 and/or the detent recesses 478 to deflect and disengage from one another. Once the detent projections 470 and the detent recesses 478 are disengaged from one another, the outer surface 476 of the skirt 474 may slide along the retainer inner surface 454 of the retainer bushing 404 as the lock 402 rotates approximately 180 degrees around the lock rotation axis 560. Once the lock 402 rotates approximately 180 degrees around the lock rotation axis 560, the detent projections 470 and the detent recesses 478 may reengage one another to releasably hold the lock 402 in that rotational position.

The lock 402 may also include a tool interface 494 in the head portion 486 to facilitate rotating the lock 402 about the lock rotation axis 560. The tool interface 494 may include any type of feature configured to be engaged by a tool for applying torque to the lock 402 about the lock rotation axis 560. When the lock 402 is seated within the lock cavity 370, the head portion 486 defining the tool interface 494 may extend at least partially through the lock cavity 370, and the second opening 376 of the lock cavity 370 may provide access for a tool to engage the tool interface 494.

Ground engaging tools and the associated retainer systems of the present disclosure are not limited to the exemplary configurations described above. In an aspect, the ground engaging tool system 200 may include a different number of lock cavities 370, and the ground engaging tool system 200 may employ a different number and configuration of posts 320, locks 402, and retainer bushings 404.

Figure 13:
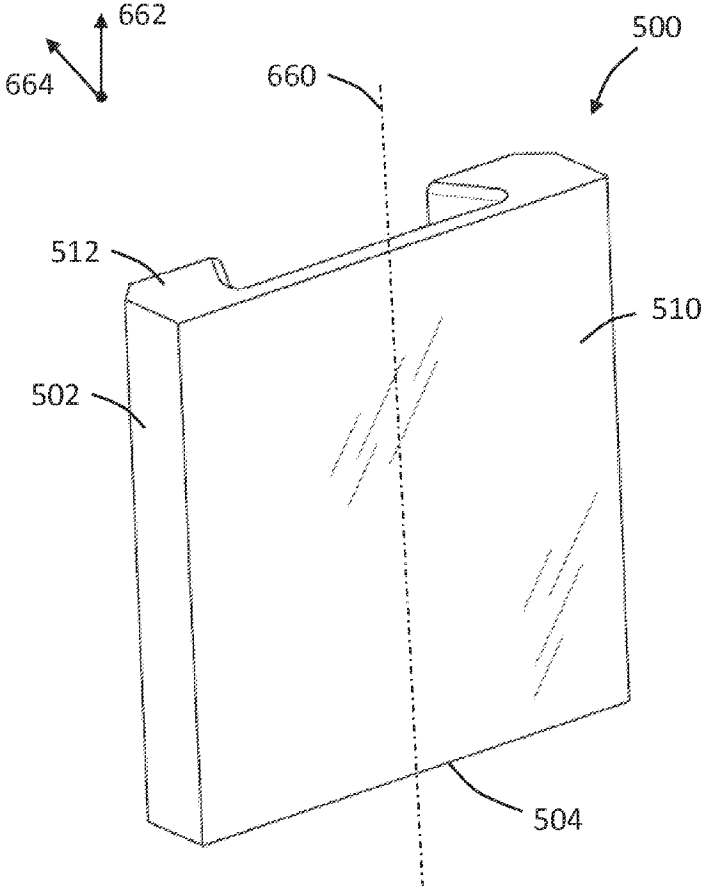
FIG. 13 is a perspective view of a back side of the slide lock retainer shown in FIG. 12.
Figure 12:
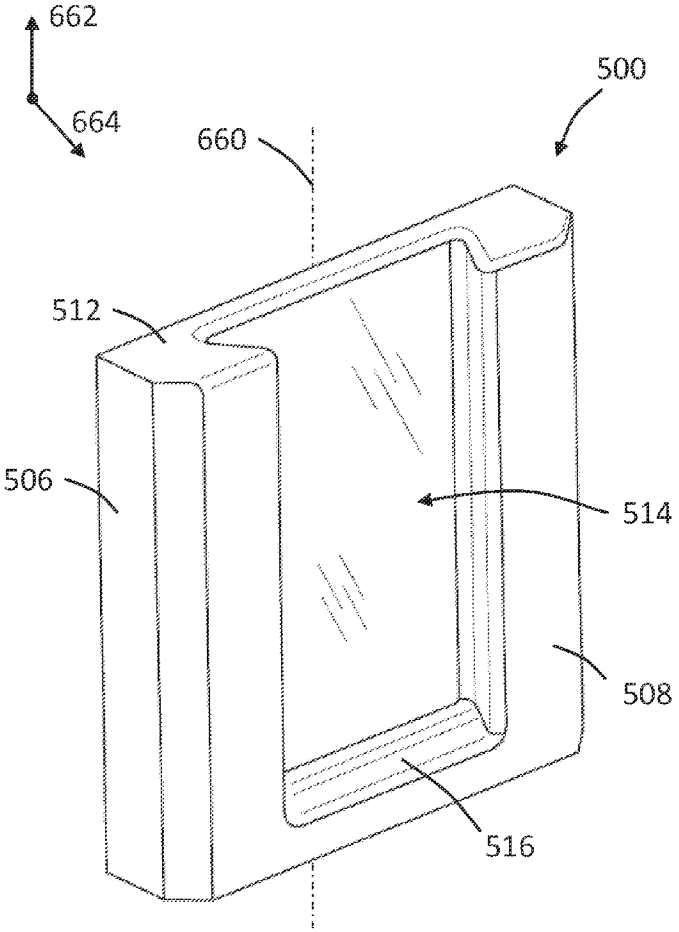
FIG. 12 is a perspective view of a front side of a slide lock retainer, according to an aspect of this disclosure.
Figure 15:
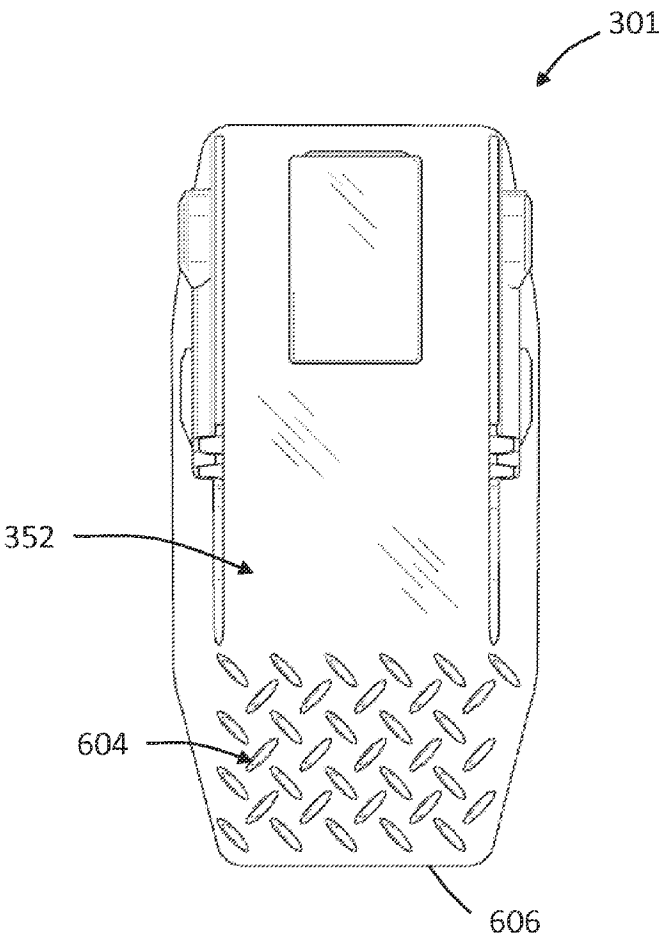
FIG. 15 is a side view of a wear plate with a second grip pattern, according to an aspect of this disclosure.
Figure 14:
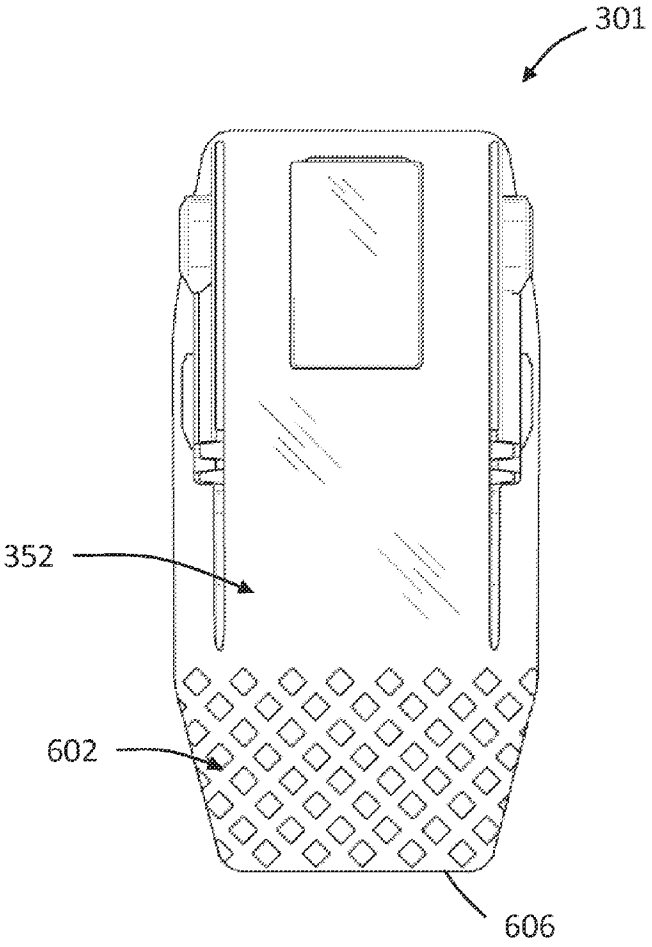
FIG. 14 is a side view of a wear plate with a first grip pattern, according to an aspect of this disclosure.

FIGS. 12 and 13 illustrate a perspective view of a front side and a back side of the slide lock retainer 500, respectively. The slide lock retainer 500 includes the first lock retainer side 502, the second lock retainer side 504, the third lock retainer side 506, a front surface 508, a back surface 510, and a fourth lock retainer side 512. The fourth lock retainer side 512 opposes the second lock retainer side 504 in a first retainer direction 662. The front surface 508 opposes the back surface 510 in a second retainer direction 664. The first retainer direction 662 may extend along a lock retainer axis 660, and the second retainer direction 664 may extend substantially perpendicular to the lock retainer axis 660.

The slide lock retainer 500 defines a slide lock channel 514 that extends from the fourth lock retainer side 512 to a first inner lock surface 516 within the slide lock retainer 500. The slide lock channel 514 may open to both the fourth lock retainer side 512 and the front surface 508 of the slide lock retainer 500. A cross section of the slide lock channel 514, as viewed from the first retainer direction 662, includes a quadrilateral shape, t-shape, combinations thereof, or other shape configured to slideably receive the slide lock member 353 within. In an aspect of this disclosure, the slide lock member 353 may slide in the first retainer direction 662 within the slide lock channel 514 from the forth lock retainer side 512 to the first inner lock surface 516 to secure the wear plate 301 to the support member 206, such that the first wear plate direction 462 aligns with the first retainer direction 662. When the slide lock member 353 is positioned within the slide lock channel 514, movement of the wear plate 301 relative to the slide lock retainer 500 in a direction perpendicular to the lock retainer axis 660 may be substantially restricted.

The slide lock retainer 500 may be coupled to the support member 206 such that the lock retainer axis 660 is substantially perpendicular to the second longitudinal axis 260 of the support member 206. The wear plate 301 may be removed from or place onto the support member 206 by sliding the wear plate 301 In an alternative aspect, the lock retainer axis 660 may be angularly offset between 0 and 90 degrees from the second longitudinal axis 260.

The front surface 352 of the wear plate 301 may be configured to improve a grip between the wear plate 301 and the work material being engaged. The wear plate 301 may include a diamond texture 602, a plank grating 604, or other surface configured to improve grip such as checker plates, rigidized surfaces, or the like. In an aspect, the front surface 352 may include a grip surface towards a bottom portion 606 of the wear plate 301.

INDUSTRIAL APPLICABILITY

Referring to FIGS. 2-13, the present disclosure provides a system and method for coupling and de-coupling the wear plate 301 to the support member 206. During a ground engaging operation, pieces of hardened material, such as rocks, concrete, or the like, contact and/or strike the wear plate 301. Over time, the wear plate 301 may become worn minimizing the effectiveness of the ground engaging operation.

An easily replaceable wear plate 301 decreases down time while still providing maximum effectiveness for the ground engaging operation. The wear plate 301 may be coupled to the support member 206 by aligning the lock access channels 372 of the wear plate 301 with the corresponding post 320 of the support member 206, and aligning the slide lock member 353 with the slide lock channel 514 of the slide lock retainer 500. After alignment, the posts 320 may slide into the corresponding lock cavities 370 and the slide lock member 353 may slide into the slide lock channel 514. The wear plate 301 may be held into place by rotating each lock 402 relative to each corresponding retainer 404 about the posts 320, thereby securing the posts 320 within the lock cavities 370. The posts 320 and the slide lock retainer 500 minimize movement of the wear plate 301 relative to the support member 206.

During operation, as the wear plate 301 becomes increasingly worn, the wear plate 301 may be de-coupled by rotating each lock 402 relative to each corresponding retainer 404 about the posts 320. After rotating each lock 402, the wear plate 301 may slide off the support member 206 by sliding the posts 320 through the lock access channels 372 and sliding the slide lock member 353 out of the slide lock channel 514.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A wear plate assembly comprising:

a wear plate having a first portion, a second portion spaced from the first portion along a first direction, a back surface, and a front surface spaced from the back surface along a second direction that is substantially perpendicular to the first direction, wherein the back surface and the front surface extend between the first portion and the second portion;

a connection plate extending from the front surface at least partially in the second direction, the connection plate having an inner surface and an outer surface spaced from the inner surface along a third direction; and a lock cavity formed by the connection plate, the lock cavity extending from a first opening that opens to the inner surface to a second opening that opens to the outer surface, wherein the first opening has a first diameter and the second opening has a second diameter that is smaller than the first diameter.

2. The wear plate assembly of claim 1, further comprising a slide lock member coupled to the front surface of the wear plate, the slide lock extending in the first direction.

3. The wear plate assembly of claim 2, wherein the slide lock member is positioned adjacent to the first portion.

4. The wear plate assembly of claim 3, wherein the slide lock member has a t-shaped cross section.

5. The wear plate assembly of claim 1, further comprising a second connection plate extending from the front surface at least partially in the second direction, the second connection plate having a second inner surface and a second outer surface spaced from the second inner surface along a fourth direction, wherein a second lock cavity is formed by the second connection plate, the lock cavity extending from a third opening that opens to the second inner surface to a fourth opening that opens to the second outer surface, wherein the third opening has a third diameter and the fourth opening has a fourth diameter that is smaller than the third diameter.

6. The wear plate assembly of claim 5, wherein the connection plate and the second connection plate are positioned adjacent to the first portion of the wear plate.

7. The wear plate assembly of claim 6, wherein the third direction and the fourth direction are substantially perpendicular to both the first direction and the second direction.

8. The wear plate assembly of claim 1, further comprising a rotatable lock positioned within the lock cavity, the rotatable lock configured to rotate between an unlocked position and a locked position, the rotatable lock including a slot configured to receive a post within, wherein when the post is received within the slot and when the lock is in the locked position the post is prevented from moving from the slot.

9. The wear plate assembly of claim 1, wherein the distance between the back surface and the front surface is less than or equal to 45 millimeters.

* * * * *